US012247578B2

(12) United States Patent
Sakota et al.

(10) Patent No.: US 12,247,578 B2
(45) Date of Patent: Mar. 11, 2025

(54) ROTARY MACHINE WITH COMPRESSOR IMPELLER

(71) Applicant: IHI Corporation, Tokyo (JP)

(72) Inventors: Koji Sakota, Tokyo (JP); Yuji Sasaki, Tokyo (JP); Shun Nakayama, Tokyo (JP)

( * ) Notice: Subject to any disclaimer, the term of this patent is extended or adjusted under 35 U.S.C. 154(b) by 0 days.

(21) Appl. No.: 18/322,602

(22) Filed: May 24, 2023

(65) Prior Publication Data

US 2023/0296108 A1 Sep. 21, 2023

Related U.S. Application Data

(63) Continuation of application No. PCT/JP2022/000531, filed on Jan. 11, 2022.

(30) Foreign Application Priority Data

Feb. 9, 2021 (JP) ..... 2021-018852

(51) Int. Cl.
*F04D 29/42* (2006.01)
*F04D 17/10* (2006.01)
(Continued)

(52) U.S. Cl.
CPC ..... *F04D 29/4206* (2013.01); *F04D 17/10* (2013.01); *F04D 25/06* (2013.01);
(Continued)

(58) Field of Classification Search
CPC ..... F04D 29/4206; F04D 17/10; F04D 25/06; F04D 29/284; F04D 29/441; F04D 25/02;
(Continued)

(56) References Cited

U.S. PATENT DOCUMENTS 2,918,207 A * 12/1959 Moore ..... F02C 6/12 417/373
3,961,867 A * 6/1976 Woollenweber ..... F04D 29/057 415/110
(Continued)

FOREIGN PATENT DOCUMENTS

JP S59-017299 1/1984
JP S63-302133 12/1988
(Continued)

OTHER PUBLICATIONS

International Search Report dated Mar. 8, 2022 for PCT/JP2022/000531.
(Continued)

*Primary Examiner* — Woody A Lee, Jr.
*Assistant Examiner* — Behnoush Haghighian
(74) *Attorney, Agent, or Firm* — SOEI PATENT & LAW FIRM

(57) ABSTRACT

A rotary machine includes a rotating shaft, a compressor impeller, a compressor housing, a diffuser plate and an impeller installing portion. The diffuser plate is fixed to the compressor housing and forms a diffuser flow path. The impeller installing portion faces the compressor impeller and is located between the rotating shaft and the diffuser plate. The diffuser plate is located around an outer circumference of the impeller installing portion and is attached to the impeller installing portion.

20 Claims, 4 Drawing Sheets

(51) Int. Cl.

| | |
|---|---|
| ***F04D 25/06*** | (2006.01) |
| ***F04D 29/28*** | (2006.01) |
| ***F04D 29/44*** | (2006.01) |
| *F04D 25/02* | (2006.01) |
| *F04D 29/58* | (2006.01) |
| *F04D 29/62* | (2006.01) |

(52) U.S. Cl.
CPC ..... *F04D 29/284* (2013.01); *F04D 29/441* (2013.01); *F04D 25/02* (2013.01); *F04D 25/0606* (2013.01); *F04D 29/5853* (2013.01); *F04D 29/624* (2013.01)

(58) Field of Classification Search
CPC ..... F04D 25/0606; F04D 29/624; F04D 29/5853; F04D 29/601
See application file for complete search history.

(56) References Cited

U.S. PATENT DOCUMENTS

| | | | | |
|---|---|---|---|---|
| 4,253,031 | A * | 2/1981 | Frister | F02B 39/10 415/176 |
| 4,301,375 | A * | 11/1981 | Anderson | H02K 7/1823 310/58 |
| 4,704,075 | A * | 11/1987 | Johnston | F01D 25/125 417/407 |
| 5,332,374 | A * | 7/1994 | Kricker | F04D 13/027 417/420 |
| 5,857,332 | A * | 1/1999 | Johnston | F16C 17/10 417/407 |
| 6,449,950 | B1 * | 9/2002 | Allen | F04D 29/057 417/407 |
| 6,668,553 | B1 * | 12/2003 | Ghizawi | F02B 39/10 415/111 |
| 6,845,617 | B1 * | 1/2005 | Allen | F02B 37/10 123/565 |
| 6,871,499 | B1 * | 3/2005 | Allen | F02B 37/10 417/407 |
| 7,458,214 | B2 * | 12/2008 | Philippe | H02K 7/14 417/406 |
| 8,152,489 | B2 * | 4/2012 | Shimizu | F02B 39/005 417/405 |
| 8,157,544 | B2 * | 4/2012 | Shimizu | H02K 5/203 417/407 |
| 8,596,413 | B2 * | 12/2013 | Seib | F04D 29/526 181/292 |
| 9,435,346 | B2 * | 9/2016 | Osuka | F04D 29/023 |
| 9,951,793 | B2 * | 4/2018 | Lucas | F04D 29/053 |
| 10,072,667 | B2 * | 9/2018 | An | F04D 25/024 |
| 10,364,761 | B2 * | 7/2019 | Sivaraman | F02B 33/40 |
| 10,364,825 | B2 * | 7/2019 | Bessho | F04D 29/4206 |
| 10,788,045 | B2 * | 9/2020 | Fujiwara | F04D 29/4206 |
| 11,156,228 | B2 * | 10/2021 | Ueno | F04D 17/10 |
| 11,177,489 | B2 * | 11/2021 | Sakota | H02K 9/06 |
| 11,248,629 | B2 * | 2/2022 | Ueno | F02B 33/40 |
| 11,293,450 | B2 * | 4/2022 | Byon | F04D 29/44 |
| 11,655,827 | B2 * | 5/2023 | Kato | F04D 17/08 415/203 |
| 11,982,221 | B2 * | 5/2024 | Yonemura | F02B 37/004 |
| 12,031,546 | B2 * | 7/2024 | Iwakiri | F04D 29/4206 |
| 2010/0247343 | A1 | 9/2010 | Shimizu et al. | |
| 2012/0148391 | A1 * | 6/2012 | Ibaraki | F04D 29/4206 415/200 |
| 2015/0345515 | A1 * | 12/2015 | Isogai | F04D 29/4206 415/115 |
| 2016/0265539 | A1 * | 9/2016 | Annati | F04D 17/10 |
| 2016/0265553 | A1 * | 9/2016 | Annati | F04D 17/10 |
| 2021/0310371 | A1 * | 10/2021 | Spathias | F01D 5/143 |

FOREIGN PATENT DOCUMENTS

| | | |
|---|---|---|
| JP | H8-312590 | 11/1996 |
| JP | 2012-067658 | 4/2012 |
| JP | 2020-033934 | 3/2020 |
| WO | 2008/020511 | 2/2008 |

OTHER PUBLICATIONS

International Preliminary Report on Patentability with Written Opinion dated Aug. 24, 2023 for PCT/JP2022/000531.

* cited by examiner

ROTARY MACHINE WITH COMPRESSOR IMPELLER

CROSS-REFERENCE TO RELATED APPLICATIONS

This application is a continuation application of PCT Application No. PCT/JP2022/000531, filed on Jan. 11, 2022, which claims the benefit of priority from Japanese Patent Application No. 2021-018852, filed on Feb. 9, 2021. The entire contents of the above listed PCT and priority applications are incorporated herein by reference.

BACKGROUND

Field

The present disclosure relates to a rotary machine.

Description of the Related Art

Rotary machines such as electric turbochargers and electric compressors are described in Japanese Unexamined Patent Publication No. S63-302133, Japanese Unexamined Utility Model Publication No. S59-17299, and Japanese Unexamined Patent Publication No. H08-312590. For example, these types of rotary machines include a center section having a motor, and a compressor connected to the center section. The compressor includes a compressor impeller contained in a compressor housing. A diffuser passage that converts kinetic energy into pressure is formed around the compressor impeller. The compressor impeller is provided to be rotatable relative to a back wall part.

SUMMARY

Disclosed herein is an example rotary machine. The rotary machine includes: a center section including a motor; a compressor impeller to be rotated by driving the motor; a compressor housing fixed to the center section and containing the compressor impeller; an impeller installing portion provided in the center section and disposed facing the compressor impeller; and a diffuser portion fixed to the compressor housing, disposed around an outer circumference of the impeller installing portion, and forming a diffuser passage. The diffuser portion is provided separately from the impeller installing portion, and is fitted and joined to the impeller installing portion.

In some examples, the diffuser portion is provided separately from the impeller installing portion, and is also fixed to the compressor housing, not the center section. Accordingly, a structure of the center section for attaching the diffuser portion can be simplified or omitted.

In some examples, the impeller installing portion may be provided including at least a region that overlaps the compressor impeller when viewed in a rotating shaft direction of the compressor impeller. Additionally, the compressor impeller can be installed by being passed through the diffuser portion after mounting the compressor impeller on the impeller installing portion. Since the compressor impeller can be mounted on the impeller installing portion before the center section and the compressor housing are connected, the compressor impeller does not tend to shift in the rotating shaft direction, and the mounting position thereof is stable. As a result, when fixing the compressor housing to the center section to form the diffuser passage, management of tip clearance between the compressor housing and the compressor impeller may be facilitated.

In some examples, the compressor housing may include an outer edge containing portion supporting the diffuser portion by accommodating an outer edge part of the diffuser portion. The diffuser portion is accommodated in the outer edge containing portion of the compressor housing, so that the diffuser portion may be held stably in position.

In some examples, the motor may further include a rotor, a stator disposed around a circumference of the rotor, and a resin mold structure fixed to an end part of the stator, and the impeller installing portion may be at least a part of the resin mold structure. Forming the impeller installing portion as an entirety or a part of the resin mold structure makes it difficult for heat generated on the side of the compressor impeller to be transmitted to the side of the stator, so that motor performance can be maintained and improved.

In some examples, the motor may include a rotor, and a stator surrounding a circumference of the rotor, the center section may include a motor housing containing an inverter configured to control the motor, the motor housing having the stator fixed thereto, and the inverter may be disposed facing the diffuser portion. A rotatory machine in which the inverter is contained in the motor housing of the center section tends to be subjected to more design constraints compared to a t rotary machine in which the inverter is installed outside the motor housing. Since the diffuser portion may be fixed to the compressor housing without a boss or the like for fixing the inverter to the motor housing, there is thus less design constraints on the shape of the inverter, so that the design freedom increases.

In some examples, the resin mold structure may include a base portion fixed to an end part of the stator, and the impeller installing portion, and the impeller installing portion may have an outer diameter smaller than an outer diameter of the base portion, and project in a direction along a rotating shaft of the compressor impeller from the base portion.

Another example rotary machine disclosed herein includes: a rotating shaft; a compressor impeller fixed to the rotating shaft; a compressor housing that accommodates the compressor impeller; a diffuser plate fixed to the compressor housing and forming a diffuser flow path; and an impeller installing portion located facing the compressor impeller and located between the rotary shaft and the diffuser plate. The diffuser plate may be located around an outer circumference of the impeller installing portion and fitted to the impeller installing portion.

Another example rotary machine may include: a motor; a motor housing that accommodates the motor; a rotating shaft to be rotated by driving the motor; a compressor impeller fixed to the rotating shaft; a compressor housing that accommodates the compressor impeller; a diffuser plate fixed to the compressor housing and forming a diffuser flow path; an inverter that is accommodated in the motor housing and controls the motor; and a resin mold structure located between the motor and the compressor housing. The resin mold structure may include an impeller installation located facing the diffuser plate. The diffuser plate may be fitted to an outer circumferential surface of the impeller installing portion.

DETAILED DESCRIPTION

In the following description, with reference to the drawings, the same reference numbers are assigned to the same components or to similar components having the same function, and overlapping description is omitted.

Figure 1:
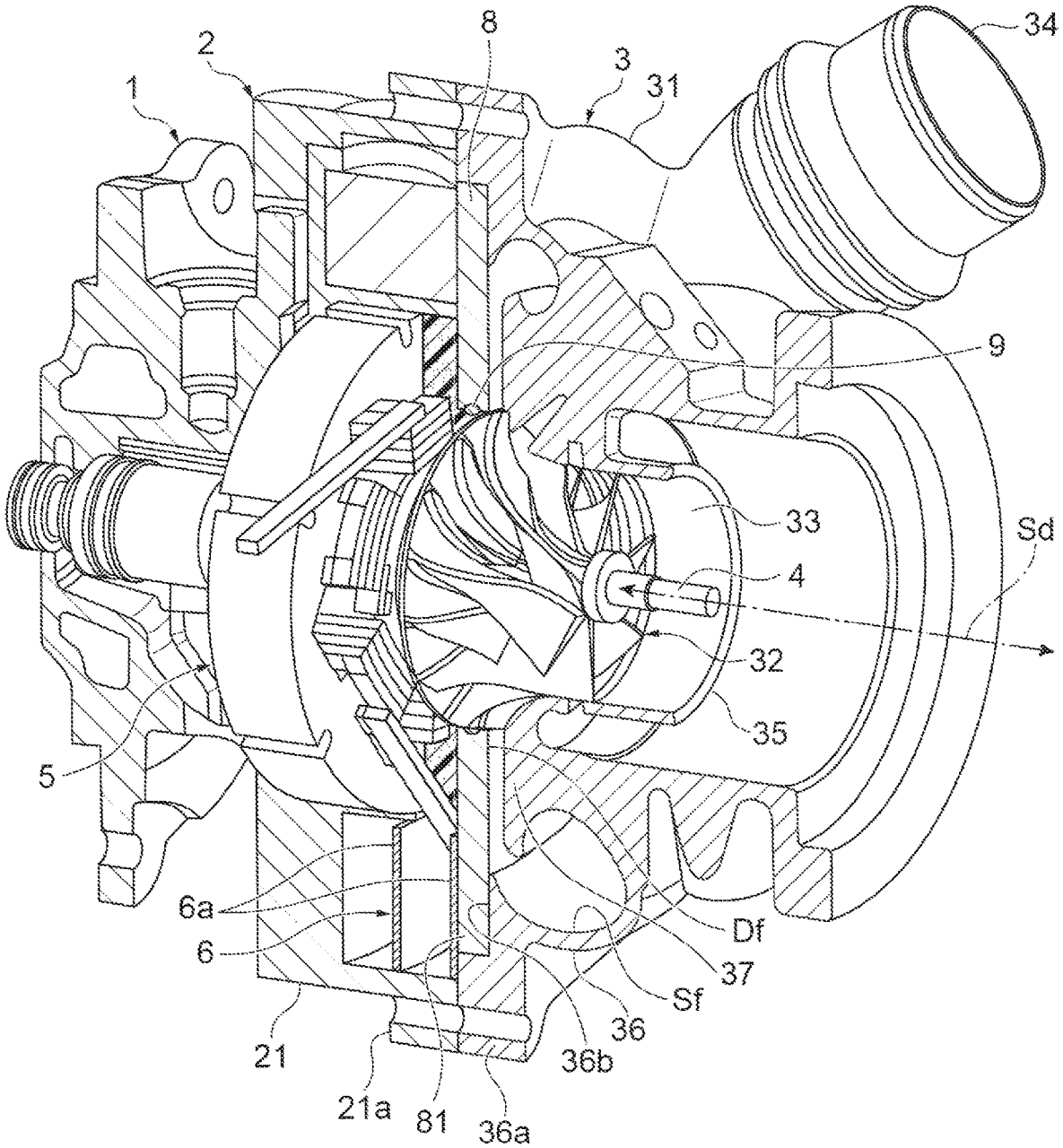
FIG. 1 is a cross-sectional perspective view illustrating an example rotary machine.

FIG. 1 illustrates an example of a rotary machine 1, which is, for example, an electric compressor. The rotary machine 1 includes a center section 2 which is a main part, and a compressor 3 connected to the center section 2. The center section 2 includes a motor 5 that drives a rotating shaft 4, and a motor housing 21 (also called a "bearing housing") that contains the motor 5. The motor 5 (see FIGS. 2 and 3) includes a rotor 51 provided on the rotating shaft 4, and a stator 52 disposed around the rotor 51. The stator 52 is composed of a core 52*a*, a conductive wire 52*b* wound around the core 52*a*, and the like, and is fixed to an inner circumferential surface of the motor housing 21.

A cooling block B, in which a cooling passage through which a coolant flows is formed, is disposed around the stator 52. An inverter 6 that controls the drive of the motor 5 is contained inside the motor housing 21.

The inverter 6 includes, for example, two (a plurality of) control boards 6*a*. The two control boards 6*a* have different functional roles, with one being a primary circuit board, and the other being a control circuit board. The control board 6*a* has a curved edge 6*x* along an outer surface 7*a* of a resin mold structure 7. A device such as an IGBT, bipolar transistor, MOSFET, or GTO, and an electrical storage device such as a capacitor are mounted on the control boards 6*a*.

The control boards 6*a* of the inverter 6 have a curved shape along an inner circumference of the motor housing 21. For example, the curved shape is an annular shape with one part removed (C-shaped), and the cooling block B is installed in the removed part.

The control boards 6*a* are attached to the motor housing 21 through an attachment member. A connection terminal 52*c* connected to the conductive wire 52*b* that extends from the stator 52 extends projecting in a tangential direction relative to a circumferential direction of the stator 52, and is connected to the control boards 6*a* of the inverter 6.

Figure 4:
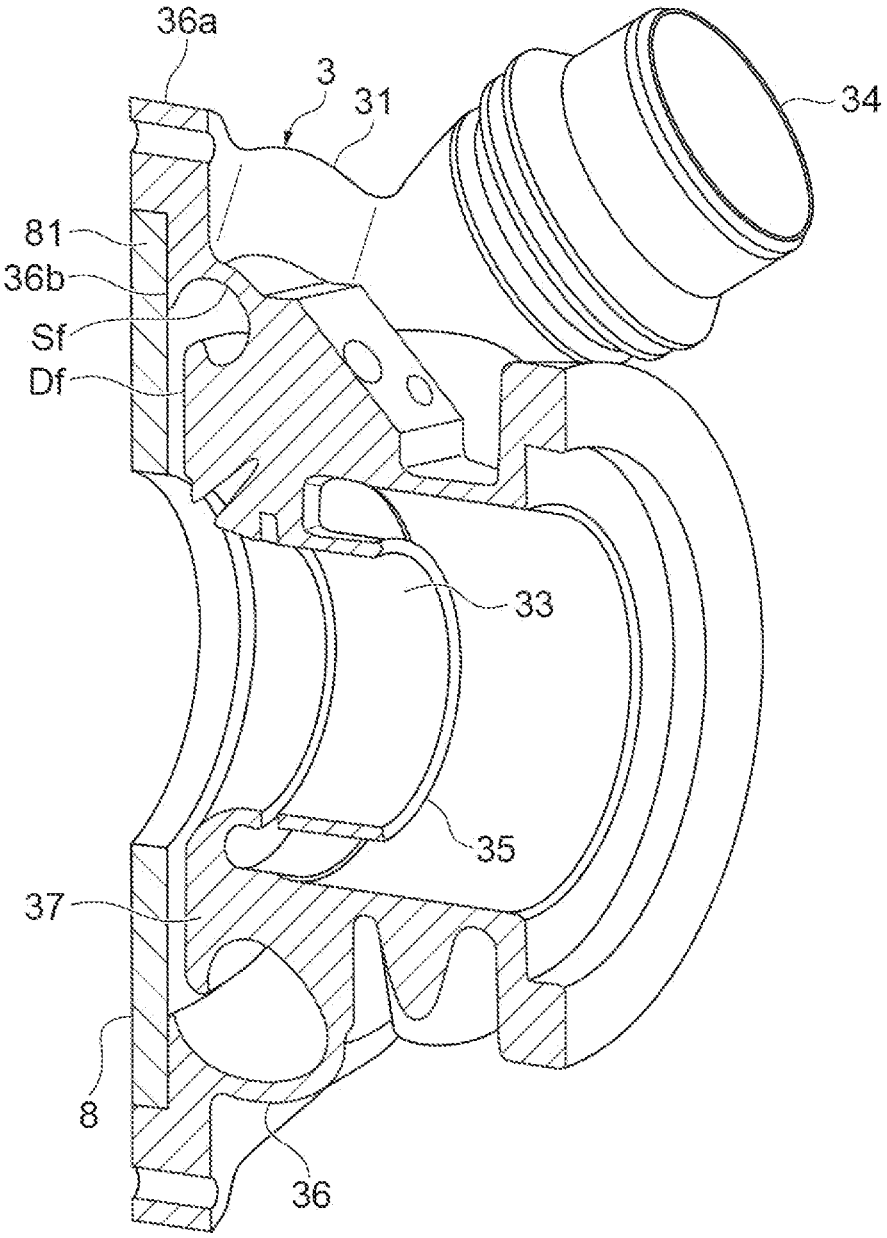
FIG. 4 is a perspective view illustrating a compressor housing with the diffuser portion fixed thereto.

The compressor 3 is a centrifugal compressor, and includes a compressor impeller 32 and a compressor housing 31 (see FIG. 4). The compressor impeller 32 is fixed to the rotating shaft 4 and rotates by the drive of the motor 5. The compressor housing 31 contains the compressor impeller 32, and includes a suction opening 33 that takes in air and a discharge opening 34 that discharges compressed air.

The compressor 3 includes a diffuser passage Df that is formed around the compressor impeller 32, and a scroll passage Sf that is provided to surround the diffuser passage Df. Kinetic energy due to the rotation of the compressor impeller 32 is converted into pressure by the diffuser passage Df. Compressed air generated in the diffuser passage Df is discharged from the discharge opening 34 via the scroll passage Sf.

The compressor housing 31 includes an inner body portion 35 that surrounds the compressor impeller 32 and in which the suction opening 33 is formed, an outer body portion 36 in which the scroll passage Sf and the discharge opening 34 are formed, and a passage communication portion 37 that is provided between the inner body portion 35 and the outer body portion 36 and forms the scroll passage Sf.

A flange portion 36*a* is provided on an outer edge part of the outer body portion 36. A flange portion 21*a* to which the compressor housing 31 is mounted is provided on an outer edge part of the motor housing 21 of the center section 2. The flange portion 36*a* of the compressor housing 31 and the flange portion 21*a* of the motor housing 21 abut each other and are connected to each other by a bolt or the like (fastening member). As a result, the compressor 3 is connected to the center section 2.

Figure 2:
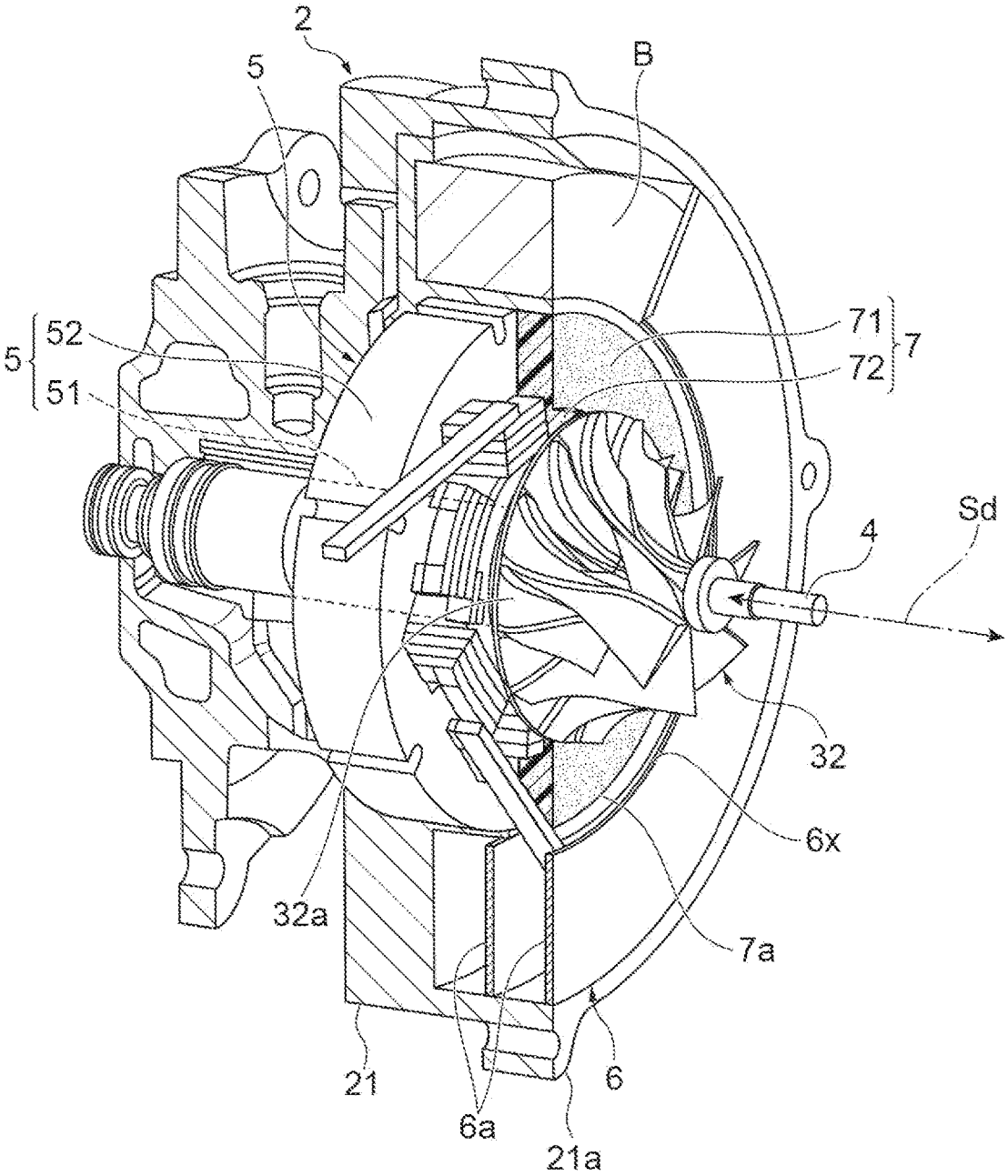
FIG. 2 is a perspective view illustrating a compressor impeller.
Figure 3:
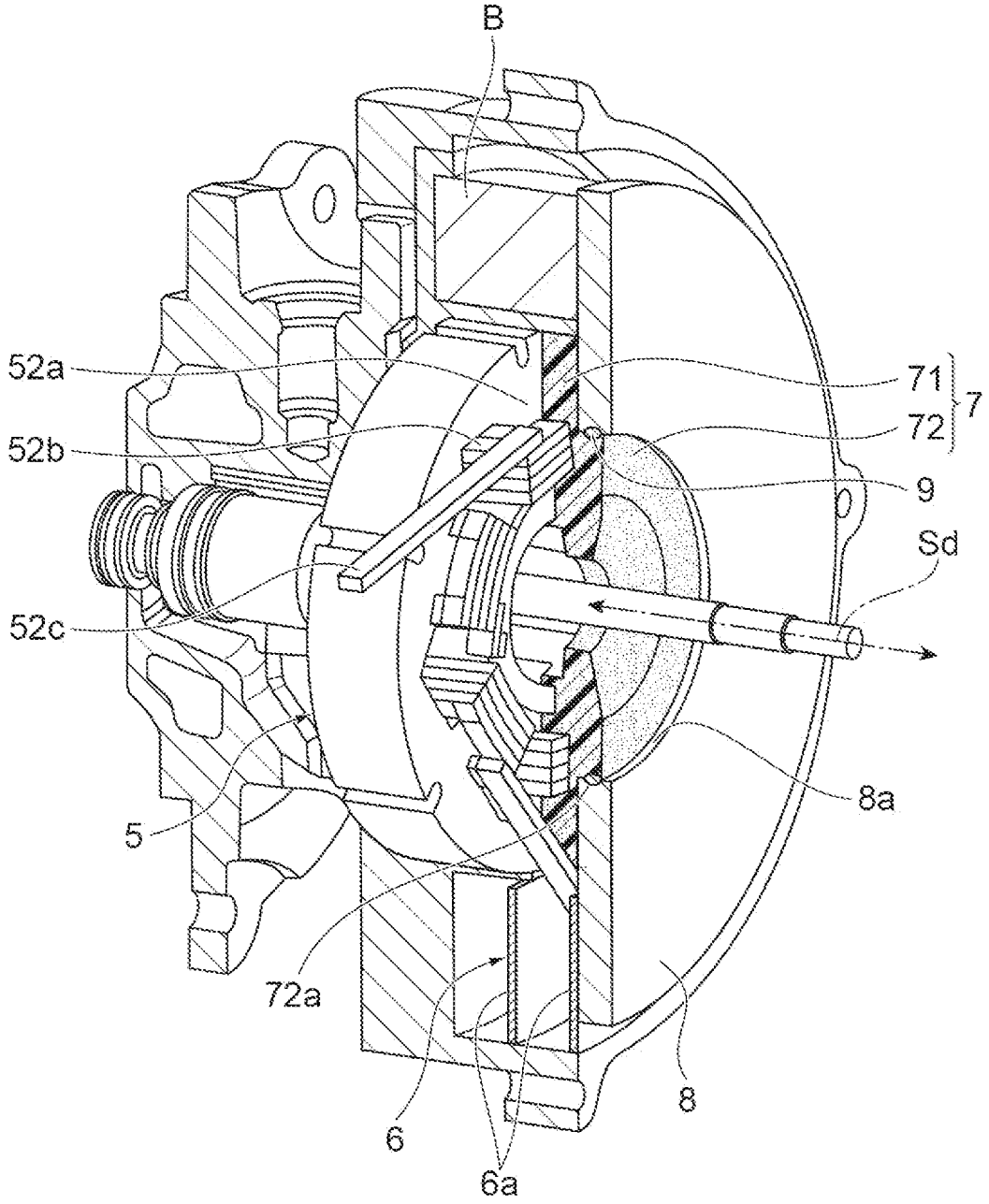
FIG. 3 is a perspective view illustrating a diffuser portion attached to an impeller installing portion.

A structure forming the diffuser passage Df is next described in detail. As illustrated in FIGS. 2 and 3, a part in which the compressor impeller 32 is rotatably installed (impeller installing portion 72) is separate from a part which forms the diffuser passage Df (diffuser portion 8), but they are eventually attached, such as being fitted and joined to each other. The impeller installing portion 72 and the diffuser portion 8 can also be described as an aspect separated in a radial direction of the rotating shaft 4. For example, the impeller installing portion 72 is an inner region closer to the rotating shaft 4 than the diffuser portion 8, and the diffuser portion 8 is an outer region. The inner impeller installing portion 72 is first described.

The resin mold structure 7, which is a resin material injected into a mold and hardened into a predetermined shape, is formed on an end part of the stator 52 closer to the compressor 3. The resin mold structure 7 includes a base portion 71 and the impeller installing portion 72. The base portion 71 is fixed to the end part of the stator 52 and protrudes in the radial direction (outward). The impeller installing portion 72 has an outer diameter smaller than that of the base portion 71, and projects in a direction along the rotating shaft 4 from the base portion 71. In some examples, the impeller installing portion 72 is formed by a part of the resin mold structure 7. In other examples, the entire resin mold structure 7 may be the impeller installing portion 72. The resin mold structure 7 is located between the rotating shaft 4 and the inverter 6.

The impeller installing portion 72 may be made of a resin integrally formed with the base portion 71. The impeller installing portion 72 is a part disposed to face the compressor impeller 32 on a back side of the compressor impeller 32. The compressor impeller 32 includes a circular compressor wheel 32*a* (see FIG. 2) provided with a plurality of blade portions. The compressor wheel 32*a* is fixed to the rotating shaft 4, and is mounted such that the back of the compressor wheel 32*a* faces the impeller installing portion 72 and the compressor wheel 32*a* is contactlessly rotatable. The back refers to a position opposite the suction opening 33.

The impeller installing portion 72 is disposed facing the compressor wheel 32*a* (compressor impeller 32). The impeller installing portion 72 is provided including at least a region that overlaps the compressor impeller 32 when viewed in a rotating shaft direction Sd of the compressor impeller 32. "When viewed in a rotating shaft direction" means when the compressor impeller 32 is viewed so as to be parallel to an extension of the rotating shaft 4. For example, it means that in a case in which the compressor impeller 32 is irradiated with light parallel to the extension of the rotating shaft 4, the region on which the compressor impeller 32 is projected is entirely included inside the impeller installing portion 72. In those examples in which outer edges of the impeller installing portion 72 and the compressor wheel 32*a* are concentric with each other, an outer diameter of the impeller installing portion 72 is the same as or greater than an outer diameter of the compressor wheel 32*a*.

The diffuser portion 8 is fitted and joined or otherwise attached to the impeller installing portion 72. The diffuser portion 8 is an annular (donut-shaped) plate body. In some examples, the diffuser portion 8 may simply be referred to as a diffuser. An end surface 8*a* (e.g., inner circumferential surface) which is an inner edge of the diffuser portion 8 is installed to surround an outer circumferential surface 72*a* of the impeller installing portion 72, and contacts the outer circumferential surface 72*a* of the impeller installing portion 72. An O-ring (sealing member) 9 for preventing leakage of compressed air from the compressor 3 is installed between the inner circumferential surface 8*a* of the diffuser portion 8 and the outer circumferential surface 72*a* of the impeller installing portion 72.

As illustrated in FIGS. 1 and 4, the outer body portion 36 of the compressor housing 31 is provided with an outer edge containing portion 36*b* which receives and supports a part of the diffuser portion 8 along an outer edge thereof. The outer edge containing portion 36*b* has a shape conforming to the shape of the part of the diffuser portion 8 along the outer edge thereof (outer edge portion 81), and is a substantially annular groove having a depth to accommodate the outer edge portion 81. The diffuser portion 8 is fixed to the compressor housing 31 through an attachment member such as a bolt, with the outer edge portion 81 accommodated in the outer edge containing portion 36*b*.

The diffuser portion 8 is accommodated in the outer edge containing portion 36*b* and fixed in a predetermined position. As a result, the diffuser portion 8 is disposed facing the passage communication portion 37 of the compressor housing 31, and is also disposed to form the diffuser passage Df between the diffuser portion 8 and the passage communication portion 37. The diffuser portion 8 is capable of forming the diffuser passage Df by being fixed to the compressor housing 31, which facilitates clearance management for forming the diffuser passage Df.

Additionally, the inverter 6 which controls the drive of the motor 5 is contained inside the motor housing 21 as described above. The two control boards 6*a* of the inverter 6 are disposed facing the diffuser portion 8. The control boards 6*a* of the inverter 6 are arranged along the rotating shaft 4. Since the diffuser portion 8 is fixed to the compressor housing 31, the motor housing 21 does not require a boss or the like for fixing the diffuser portion 8. As a result, this eliminates the need for considerations such as of making adjustments to the shape of the control boards 6*a* (inverter 6) to avoid a boss or the like, so that there is less design constraints on the shape of the inverter 6.

The diffuser portion 8 of the rotary machine 1 and the impeller installing portion 72 are separate components. The diffuser portion 8 and the impeller installing portion 72 are joined together. Additionally, the diffuser portion 8 is fixed to the compressor housing 31, not the center section 2. As a result, a structure of the center section 2 for attaching the diffuser portion 8 can be simplified or omitted, thereby improving the design freedom of the center section 2.

For example, in a case in which the impeller installing portion and the diffuser portion are not separate, and are installed at the back of the compressor impeller as an integral back plate, the back plate would require being fixed, for example, to the motor housing of the center section. In the example, the compressor housing may be attached to the center section through the back plate, and the compressor housing would be stacked in the rotating shaft direction Sd. As a result, tolerance in the rotating shaft direction Sd may increase.

An example rotary machine 1 has the impeller installing portion 72 which is separate from the diffuser portion 8, and the diffuser portion 8 which is fixed to the compressor housing 31. Additionally, the motor housing 21 of the center section 2 and the compressor housing 31 can also be directly fixed to each other without the diffuser portion 8 interposed therebetween. The rotary machine 1 can be compacted in the rotating shaft direction Sd, to facilitate the management of tip clearance between the compressor impeller 32 and the compressor housing 31.

In some examples, the impeller installing portion 72 is provided including at least a region that overlaps the compressor impeller 32 when viewed in the rotating shaft direction Sd of the compressor impeller 32. As a result, the compressor impeller 32 can be installed by being passed through the diffuser portion 8 after the compressor impeller 32 is mounted on the impeller installing portion 72. That is, the compressor impeller 32 can be mounted on the impeller installing portion 72 before the center section 2 and the compressor housing 31 are connected. Thus, the compressor impeller 32 does not tend to shift in the direction along the rotating shaft 4, and the mounting position thereof is stable. When fixing the compressor housing 31 to the center section 2 to form the diffuser passage Df, the management of the tip clearance between the compressor housing 31 and the compressor impeller 32 is facilitated.

In some examples, the diffuser portion 8 fixed to the compressor housing 31 is accommodated in the outer edge containing portion 36*b* of the compressor housing 31, so that the diffuser portion 8 is held stably in position. As the result, the rotary machine 1 can be compacted in the rotating shaft direction Sd.

In some examples, since the impeller installing portion 72 is a part of the resin mold structure 7 fixed to the stator 52, heat generated on the side of the compressor impeller 32 does not tend to be transmitted to the side of the stator 52, so that the performance of the motor 5 can be maintained and improved.

In some examples, the inverter 6 is contained inside the motor housing 21 of the center section 2. The diffuser portion 8 is fixed to the compressor housing 31 in the rotary machine 1 to facilitate disposing the inverter 6 and the diffuser portion 8 opposing each other in close proximity.

It is to be understood that not all examples, advantages and features described herein may necessarily be achieved by, or included in, any one particular example. Indeed, having described and illustrated various examples herein, it should be apparent that other examples may be modified in arrangement and detail. For example, although an electric compressor has been described as an example of the rotary machine in the above, some examples can be widely applied to rotary machines that form a diffuser passage, such as electrically assisted turbochargers.

What is claimed is:

1. A rotary machine comprising:

a center section including a motor;

a compressor impeller configured to be rotated by driving the motor;

a compressor housing fixed to the center section and containing the compressor impeller;

a base portion fixed to the motor in the center section;

an impeller installing portion projecting in a direction along a rotating shaft of the compressor impeller from the base portion, and facing the compressor impeller; and a diffuser portion fixed to the compressor housing, disposed around an outer circumference of the impeller installing portion, and forming a diffuser passage, wherein the diffuser portion and the impeller installing portion are separate components that are joined together, wherein the base portion faces the diffuser portion in the direction along the rotating shaft, and wherein the impeller installing portion is located between the diffuser portion and the rotating shaft, and has an outer diameter smaller than an outer diameter of the base portion.

2. The rotary machine according to claim 1, wherein the impeller installing portion at least partially overlaps the compressor impeller when viewed in a rotating shaft direction of the compressor impeller.

3. The rotary machine according to claim 1, wherein the compressor housing includes an outer edge containing portion that supports an outer edge part of the diffuser portion.

4. The rotary machine according to claim 1, wherein the motor includes a rotor, and a stator surrounding a circumference of the rotor, wherein the center section includes a motor housing containing an inverter configured to control the motor, the motor housing having the stator fixed thereto, and wherein the inverter faces the diffuser portion.

5. The rotary machine according to claim 1, wherein the motor includes a rotor, a stator disposed around a circumference of the rotor, and a resin mold structure fixed to the stator, and wherein the impeller installing portion forms at least part of the resin mold structure.

6. The rotary machine according to claim 1, wherein the impeller installing portion is located between a rotating shaft of the compressor impeller and the diffuser portion.

7. The rotary machine according to claim 1, wherein the diffuser portion comprises an inner circumferential surface abutting to an outer circumferential surface of the impeller installing portion.

8. The rotary machine according to claim 7, further comprising a seal located between the inner circumferential surface and the outer circumferential surface.

9. A rotary machine comprising:

a center section including a motor;

a compressor impeller configured to be rotated by driving the motor;

a compressor housing fixed to the center section and containing the compressor impeller;

an impeller installing portion located in the center section and facing the compressor impeller; and a diffuser portion fixed to the compressor housing, disposed around an outer circumference of the impeller installing portion, and forming a diffuser passage, wherein the diffuser portion and the impeller installing portion are separate components that are joined together, wherein the motor includes a rotor, a stator disposed around a circumference of the rotor, and a resin mold structure fixed to the stator, wherein the impeller installing portion forms at least part of the resin mold structure, wherein the resin mold structure includes a base portion fixed to the stator, and the impeller installing portion, and wherein the impeller installing portion has an outer diameter smaller than an outer diameter of the base portion, and projects in a direction along a rotating shaft of the compressor impeller from the base portion.

10. A rotary machine comprising:

a rotating shaft;

a motor comprising a rotor provided on the rotating shaft, and a stator located around the rotor;

a compressor impeller fixed to the rotating shaft;

a compressor housing that accommodates the compressor impeller;

a diffuser plate fixed to the compressor housing and forming a diffuser flow path;

a base portion made of resin that is fixed to the stator and faces the diffuser plate in a rotating shaft direction of the compressor impeller; and an impeller installing portion that faces the compressor impeller and is located between the rotating shaft and the diffuser plate, wherein the diffuser plate is located around an outer circumference of the impeller installing portion and is attached to the impeller installing portion.

11. The rotary machine according to claim 10, wherein the impeller installing portion has an outer diameter that is smaller than an outer diameter of the base portion.

12. The rotary machine according to claim 11, wherein the impeller installing portion projects from the base portion in a rotating shaft direction of the compressor impeller and faces the compressor impeller in the rotating shaft direction.

13. The rotary machine according to claim 10, wherein the impeller installing portion is made of the resin integrally formed with the base portion.

14. The rotary machine according to claim 10, wherein the base portion is located between the stator and the diffuser plate.

15. The rotary machine according to claim 10, further comprising a seal located between the diffuser plate and the impeller installing portion.

16. A rotary machine comprising:

a compressor impeller;

a compressor housing that accommodates the compressor impeller;

a diffuser plate fixed to the compressor housing and forming a diffuser flow path;

a motor configured to rotate a rotating shaft of the compressor impeller;

a motor housing that accommodates the motor;

an inverter that is accommodated in the motor housing to control the motor; and a resin mold structure located between the motor and the compressor housing, wherein the resin mold structure comprises an impeller installing portion that faces the compressor impeller, and wherein the resin mold structure is located between the rotating shaft and the inverter.

17. The rotary machine according to claim 16, wherein the inverter comprises a control board having a curved edge along an outer surface of the resin mold structure.

18. The rotary machine according to claim 16, further comprising a rotating shaft fixed to the compressor impeller, wherein the diffuser plate is located around an outer circumference of the impeller installing portion and is attached to the impeller installing portion.

19. The rotary machine according to claim 18, wherein the motor comprises:

a rotor fixed to the rotating shaft; and a stator surrounds the rotor, wherein the resin mold structure further comprises a base portion, wherein the impeller installing portion projects in a direction along the rotating shaft from the base portion, and wherein the base portion is located between the stator and the diffuser plate.

20. The rotary machine according to claim 18, wherein the impeller installing portion is located between the rotating shaft and the diffuser plate.

* * * * *